United States Patent [19]

Viegas et al.

[11] 4,182,134

[45] Jan. 8, 1980

[54] TRANSPORT REFRIGERATION UNIT

[75] Inventors: Herman H. Viegas, Richfield; Bruce D. Johnson, Rosemount; Rodney H. Volk, Eden Prairie, all of Minn.

[73] Assignee: Thermo King Corporation, Minneapolis, Minn.

[21] Appl. No.: 933,933

[22] Filed: Aug. 15, 1978

[51] Int. Cl.[2] ..... F25D 19/00

[52] U.S. Cl. ..... 62/298; 62/323; 62/448; 62/263; 62/262

[58] Field of Search ..... 62/298, 323, 263, 262, 62/449, 448, 450

[56] References Cited

U.S. PATENT DOCUMENTS

| | | | |
|---|---|---|---|
| 2,263,476 | 11/1941 | Sunday | 62/239 |
| 2,630,687 | 3/1953 | Action | 62/239 |
| 2,735,277 | 2/1956 | Clark | 62/239 |
| 3,871,188 | 3/1975 | Vold et al. | 62/298 |

OTHER PUBLICATIONS

Bulletin Form TK 2941-5 XUWD Thermo King 5/1978.

*Primary Examiner*—Ronald C. Capossela
*Attorney, Agent, or Firm*—E. C. Arenz

[57] ABSTRACT

A component and structural arrangement of a transport refrigeration unit for the front wall of a trailer and which utilizes a generally planar frame attached to the front wall to provide a support arrangement in which the load of the components is transferred back to the planar frame, and which includes an airflow plenum through which trailer air is passed for conditioning which is disposed relative to the plane of the frame with a material part of the front-to-rear depth of the plenum being forwardly of the plane to significantly reduce the projection of the plenum into the trailer cargo space.

10 Claims, 6 Drawing Figures

TRANSPORT REFRIGERATION UNIT

BACKGROUND OF THE INVENTION

This invention pertains generally to the art of transport refrigeration units and in particular to that part of the art relating to component and structural arrangements for such units.

There are a number of obviously desirable characteristics which those in the business of manufacturing transport refrigeration units would like their units to have. For example, it is desirable that the part of the unit which projects into the transport trailer take up relatively little space therein to accordingly increase the available cargo space. It is desirable to provide a unit which lends itself to easy access for maintenance and service. The unit should be able to be manufactured without undue difficulty, should be as light in weight as possible while having adequate structural strength, and should provide adequate refrigerant capacity for its intended service. Those skilled in the art know of a number of other desiderata which, each taken alone without consideration of the impact upon the others, may be relatively easy to achieve.

Patents which address themselves to transport refrigeration units and which may be considered material in the sense of prior art with respect to this application are U.S. Pat. Nos. 3,871,188; 2,735,277, 2,630,687; and 2,263,476. However, none of these are considered to have teachings which disclose or suggest the overall arrangement of this invention.

SUMMARY OF THE INVENTION

In accordance with this invention, the transport refrigeration unit for the front wall of a trailer includes a generally planar frame which mounts against the front wall of the trailer and seals around an opening in the front wall, and includes a generally vertically disposed airflow plenum which is encompassed by the upper part of the frame above an intermediate level cross member of the frame with the plenum being disposed relative to the plane of the frame with a material part of the front-to-rear depth of the plenum being forwardly of the plane of the frame. Upper support means extend forwardly from the upper part of the frame to provide total support of a condenser from the frame, lower support means also extend forwardly from the lower part of the frame below the plenum to totally support an engine-compressor unit from the frame in a position underlying the condenser and the forward part of the plenum. The plenum has a refrigerant evaporator in the lower part of the plenum in a generally diagonal disposition and with the upper part of the plenum having a separate rear space and a separate front space, the front space being in communication with the upper airflow space of the evaporator and the rear space being in communication with the interior of the trailer. An evaporator blower is provided in the upper part of the plenum to circulate air to the trailer through the plenum, and a removable cover is secured to the planar frame to encompass those parts forwardly of the planar frame.

Among the features which are currently considered to be the more important ones of the invention are the following. The planar frame which is secured to the trailer wall has the load from the parts, such as the condenser and the engine-compressor unit which are located forwardly of the frame, transferred directly back to the main frame to avoid the typical conventional front box frame which also forms a part of the shell. This part of the arrangement provides a number of advantages which will be noted hereinafter.

Another feature is that the plenum through which the air for conditioning the trailer interior is passed is in effect displaced forwardly out of the trailer interior for about half of its depth so that it only projects into the trailer interior for about the same depth as that of an interior vertical duct normally used to insure the return of air to the unit from the space around the floor of the trailer.

DRAWING DESCRIPTION

DESCRIPTION OF THE PREFERRED EMBODIMENTS

Figure 1:
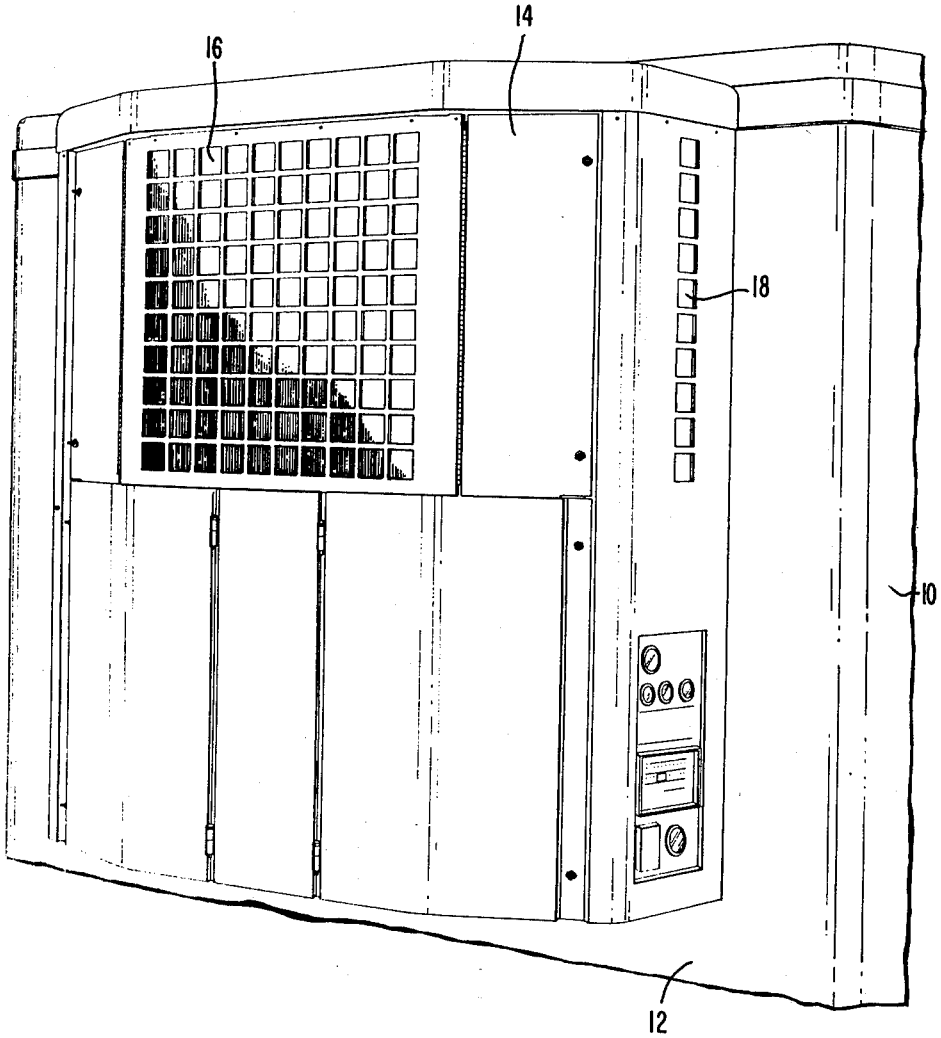
FIG. 1 is an isometric view of the front of a trailer having a transport refrigeration unit according to the invention mounted thereon.

In FIG. 1 a fragmentary front part of a large transport trailer 10 is shown with a transport refrigeration unit according to the invention shown mounted on the front wall 12 of the trailer, the upper part of the front cover 14 of the unit including an air inlet grille 16 and side air outlet grilles 18 (only one shown). In the embodiment illustrated in FIG. 1 and as will be more apparent in FIGS. 2 and 3, the condenser and radiator for the unit are located behind the rectangular grille 16, while the so-called power pack (engine-compressor) is the main component located behind the lower part of the front cover.

Figure 2:
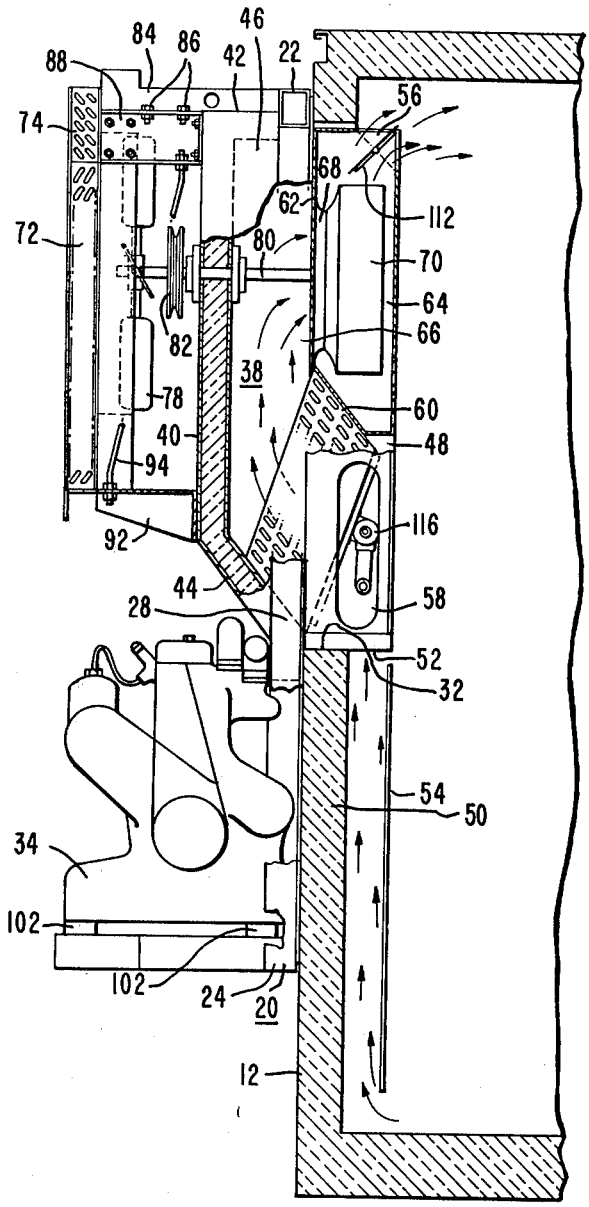
FIG. 2 is a side view, partly in section, partly broken, and being partly schematic and in outline, of a unit having the arrangement according to the invention.
Figure 3:
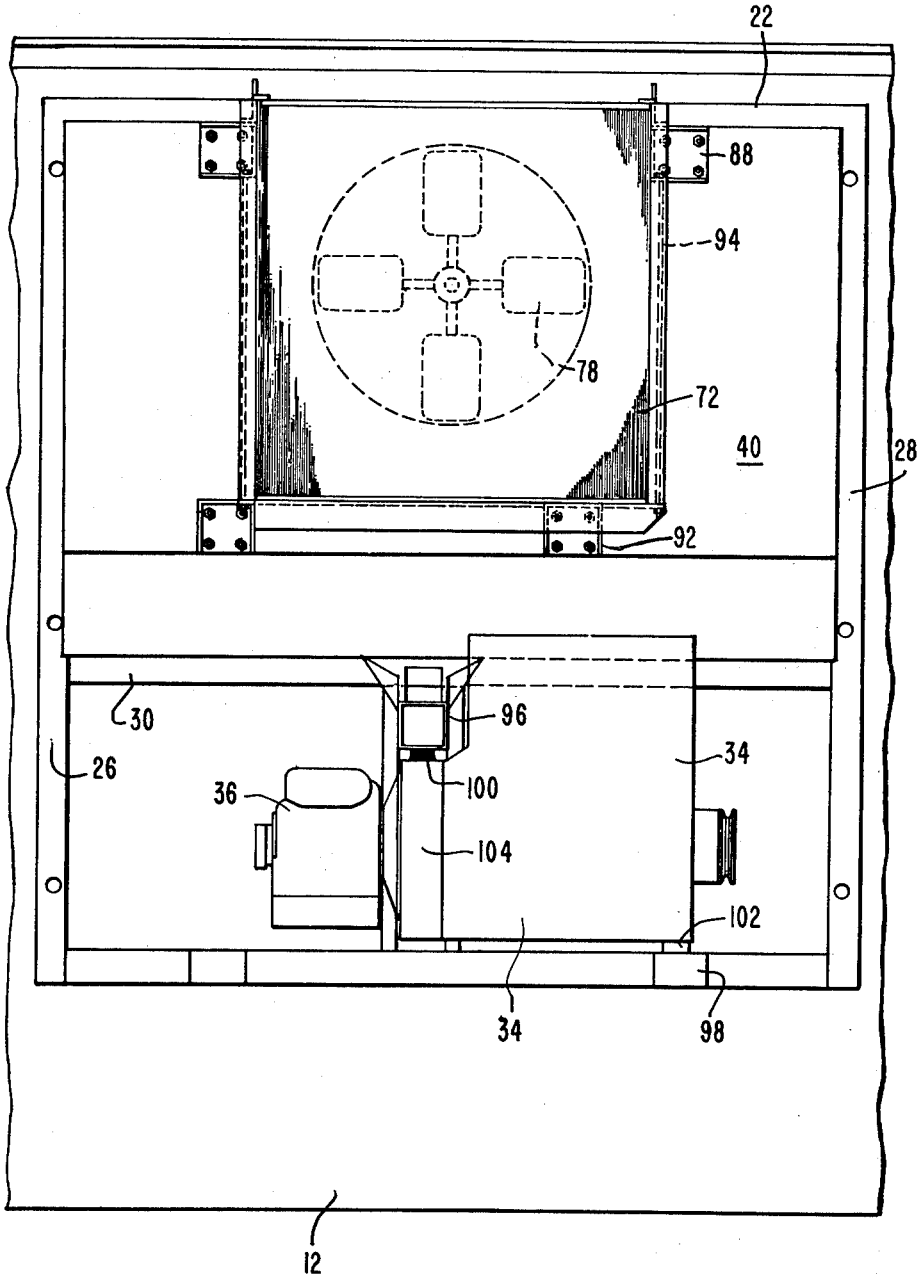
FIG. 3 is a front outline view of the unit with the front shell and other parts omitted for clarity.

Referring now to FIGS. 2 and 3, these views are intended to disclose the general locational arrangement of the major parts of the unit. The arrangement includes a generally planar frame designated 20 which has a rectangular form as viewed in outline and as seen in FIG. 3 includes a top member 22, a bottom member 24, opposite side members 26 and 28, and intermediate cross member 30. The parts of the frame are either box- or channel-shaped in transverse section and the frame is adapted to be mounted and secured against the front wall 12 of the trailer and seal around the opening 32 provided in the front wall of the trailer.

The power pack for the refrigeration unit, which is shown in FIGS. 2 and 3 in outline form, includes an internal combustion engine 34 and a refrigerant compressor 36 driven thereby and connected together to form an integral engine-compressor unit. This engine-compressor unit is located in the front bottom space of the unit, the terms front and rear being used in this patent application in the same directional sense as that of the trailer to which the refrigeration unit is mounted.

The upper part of the refrigeration unit includes a generally vertically disposed chamber herein called a plenum generally designated 38 (FIG. 2) which is encompassed by the upper part of the frame above the intermediate cross member 30, the plenum being disposed relative to the general plane of the frame 20 with a material part of the front-to-rear depth of the plenum being forwardly of the plane to thereby materially reduce the depth of the plenum which projects through the opening into the interior of the trailer. The plenum of course is the part into which air from the trailer is drawn, the air being circulated through the plenum and conditioned if necessary and returned to the trailer. In the illustrated embodiment the front-to-rear depth of the plenum is approximately the same on opposite sides of the general plane of the frame 20. The parts of the plenum which extend forwardly from the trailer front face include a vertical front wall 40, a horizontal top wall 42, a sloping bottom wall 44 and opposite sidewalls 46, each of these walls being thermally insulated on their inside faces because of the exposure of the walls to varying ambient temperatures. The part of the plenum which lies in the opening 32 of the trailer and projects into the trailer interior cargo space basically only includes sidewalls 48 since that part of the bottom of the plenum which is not blocked by the depth (typically about 4 inches) of the thermal insulation 50 of the front trailer wall 12 is open as at 52 to permit airflow into or out of the plenum via the vertically disposed duct 54 and the top part provides the opposite opening 56 for placing the interior of the plenum in communication with the interior of the trailer. The opposite sidewalls 48 of the plenum also each have additional air openings 58 in the lower portions thereof toward the rear.

The plenum contains a heat exchange coil 60 which, in normal usage, functions as a refrigerant evaporator. It is of conventional fin and tube construction but is provided with a rhomboidal shape in cross section and as disposed in the lower part of the plenum slopes upwardly and rearwardly. A vertically disposed partition 62 separates the upper portion of the plenum into an upper rear space 64 and an upper front space 66, the upper front space being in communication with the upper airflow face of the evaporator 60 while the upper rear space is in communication with the interior of the trailer through the opening 56. The partition 62 includes a centrally located blower inlet 68 which, in the disposition of the centrifugal blower 70 as shown in FIG. 2, places the interior of the blower in communication with the upper front space 66.

In the upper front portion of the refrigeration unit forwardly of the plenum 38, a refrigerant condenser 72 is mounted in a vertical disposition, with the engine radiator 74 being located immediately above it and in the same general plane. In the currently preferred form, the condenser and radiator are an integral assembly in the fins for the tubes of both are unbroken. Both the condenser and radiator are spaced forwardly of the plenum sufficiently to provide a space 76 for a fan or blower 78 mounted on a shaft 80 which is common to the evaporator blower 70. The shaft 80 is rotated by a pulley 82 driven by a belt (not shown) which extends over various idler pulleys (also not shown) mounted on the plenum front wall to a drive pulley at the end of the engine crankshaft.

Significant features of the invention include the mounting and support arrangement for the condenser and radiator elements forwardly of the plenum in a manner in which the total support is transferred back to the frame 20 so that the provision of any box-like frame forwardly of the generally planar frame 20 is avoided. To accomplish this, upper support means are provided to extend forwardly from the upper part of the frame 20 and the front wall 40 of the plenum to provide the total support of the condenser 72 and radiator 74. Such upper support means include one pair of spaced-apart upper beam members 84 (FIGS. 2 and 5), these beams having their rear ends welded to the top cross member 22 of the planar frame, and are of Z-shape in cross section with the lower flange of the members being bolted or otherwise secured as at 86 to the upper flange of a shorter underlying beam member 88. Beam member 88 which has an upper and lower triangular flange has its rear leg secured as by bolts 90 to the front of the reinforced plenum. The forwardly extending leg **88*a* is connected to the side plates of the condenser-radiator assembly at opposite sides thereof. Thus the condenser-radiator assembly is supported at the top in a generally cantilever fashion through the upper support beams 84 and 88 through the reinforced plenum which in turn transfers the load back to the planar frame 20** at the top.

To further support the condenser-radiator assembly, a pair of lower spaced-apart support members 92 have their rear ends fastened to the plenum front and project forwardly for fastening to the lower part of the condenser sides, these lower members 92 including an upper horizontal flange so that the diagonal tie rods 94 which extend between the flanges of the members 88 and 92 may be used to aid in transferring the load back to the planar frame.

Figure 4:
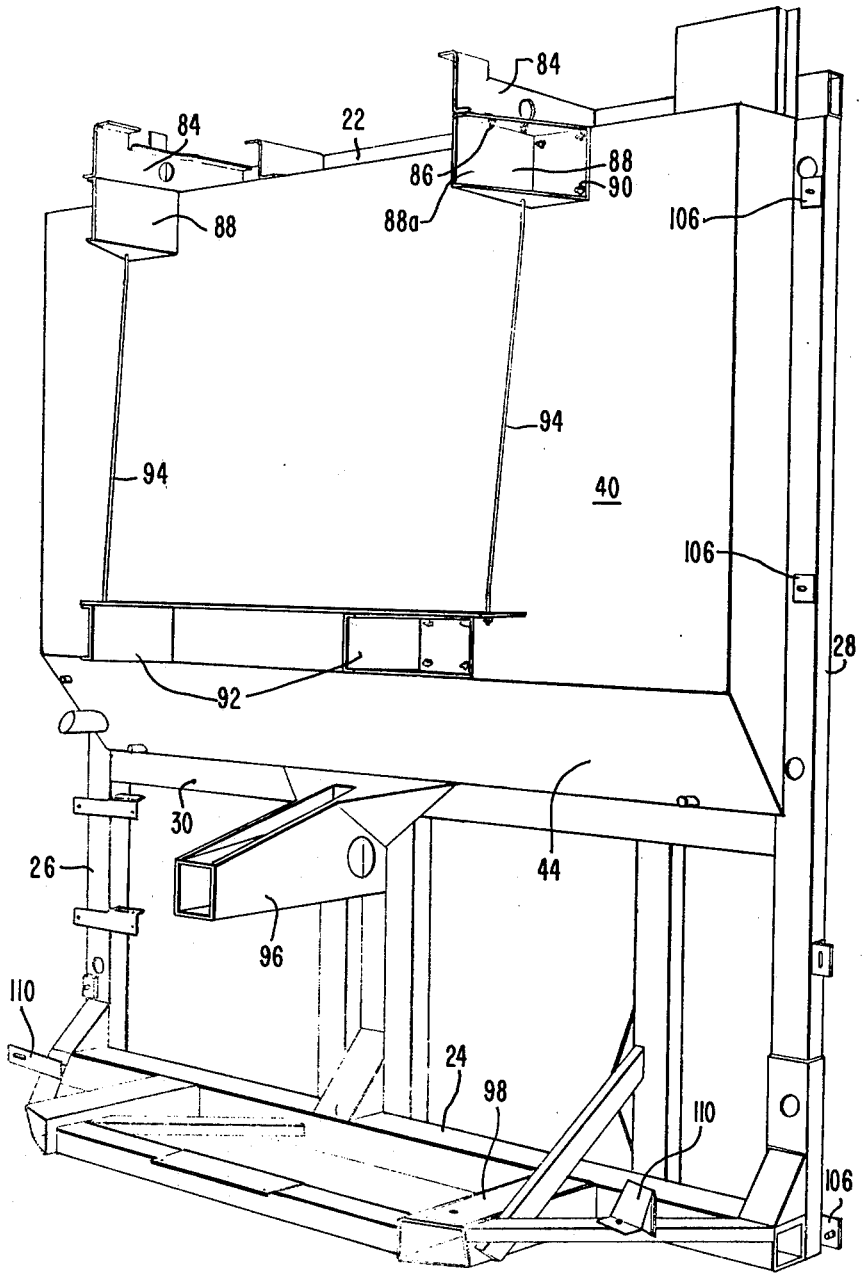
FIG. 4 is a perspective view of the basic structural parts of the unit as viewed from the front side and with the operating components omitted to emphasize the basic frame and plenum.

The support for the engine compressor unit is also of a generally cantilever nature which carries the load directly back to the planar frame 20. Referring to FIGS. 3 and 4, the lower support means which extend forwardly from the lower part of the frame below the plenum to support the engine-compressor unit include an upper cantilever beam 96 which projects forwardly from the cross member 30 of the planar frame and a lower beam 98 projecting forwardly from the bottom member 24 of the planar frame, the upper cantilever beam 96 projecting forwardly from a location generally near the center of the unit with respect to its width, and the lower beam being located considerably to the right as viewed in FIGS. 3 and 4. Both of these beams are generally of a box-frame shape in cross section, and the lower face of the beam 96 carries a front and rear engine mounting pad 100 and the upper face of the lower beam 98 also carries front and rear engine mounting pads 102. The left end of the engine is mounted at its upper side through the flywheel housing 104 and the mounting pads 100 to the cantilever beam 96. The crankshaft pulley end of the engine is mounted at its bottom side through the pads 102 to the beam 98. These beams are located relative to the particular engine dimension so that the mounting plane, that is a plane which corresponds to one which passes through all four mounting locations, will pass in the general vicinity of the center of gravity of the engine-compressor unit. This mounting arrangement for the engine-compressor unit reduces vibration and accordingly the noise level generated by vibration of components. While it is known in the general engine art that such a mounting arrangement has the attribute of reduction of vibration, so far as we are aware it is not known to provide an engine-compressor unit in a transport refrigeration unit mounted in this particular fashion, and particularly in connection with a generally cantilever approach carrying the load back to a planar frame as described heretofore.

The front cover means 14, omitted in all views except FIG. 1, is secured at strategic locations to the planar frame on both sides as at 106 to the base 108 at points such as 110 and through the generally open top to the forward ends of the upper beams 84 and at brackets attached to 22. The cover means does not function to any significant degree to provide structural support to the members forwardly of the planar frame and it may be removed relatively easily as a whole to provide generally unobstructed access to those parts forwardly of the frame. The cover means is also provided with individual doors to provide access to one or another of the forward parts of the unit without removal of the entire cover.

As noted before, the typical construction for large transport refrigeration units has a box frame shape including front corner posts, with the front covering basically consisting of a number of doors or panels attached to the frame. That construction lacks a number of advantages available with the construction of this invention. Since the arrangement according to the invention transfers the load of the parts in front directly to the planar frame which is bolted to the trailer front wall, the overall frame weight is reduced by avoiding unnecessary secondary members to box-in the frame as is done with the typical current units. With the absence of the secondary members of a box frame, with the cover partly or fully removed the arrangement of this invention provides unrestricted access to the complete power pack and other major components at the forward side of the unit, thus facilitating field repair services as well as the factory assembly of components onto the frame. Since the cover does not perform a structural support function of any significance, there is relatively complete freedom for designing the cover configuration to accommodate aesthetics, aerodynamic streamlining, sound deadening, and shell materials. Another advantage is that the basic refrigeration unit minus the cover can be built and stocked in one or a limited number of basic colors (it being typical in the trade that the frame and a number of the basic internal components be painted) and the cover means can be painted according to the customer's desire. This is not conveniently possible with the conventional box frame construction since parts of the frame are visible as parts of the exterior. Finally, since the internal components are supported from the planar frame with the cover basically "floating" with respect to any direct attachment to these components, limited damage can occur to the cover without any damage in the nature of misalignment and so on occurring to the interior components, since they are not connected directly to the cover.

Figure 5:
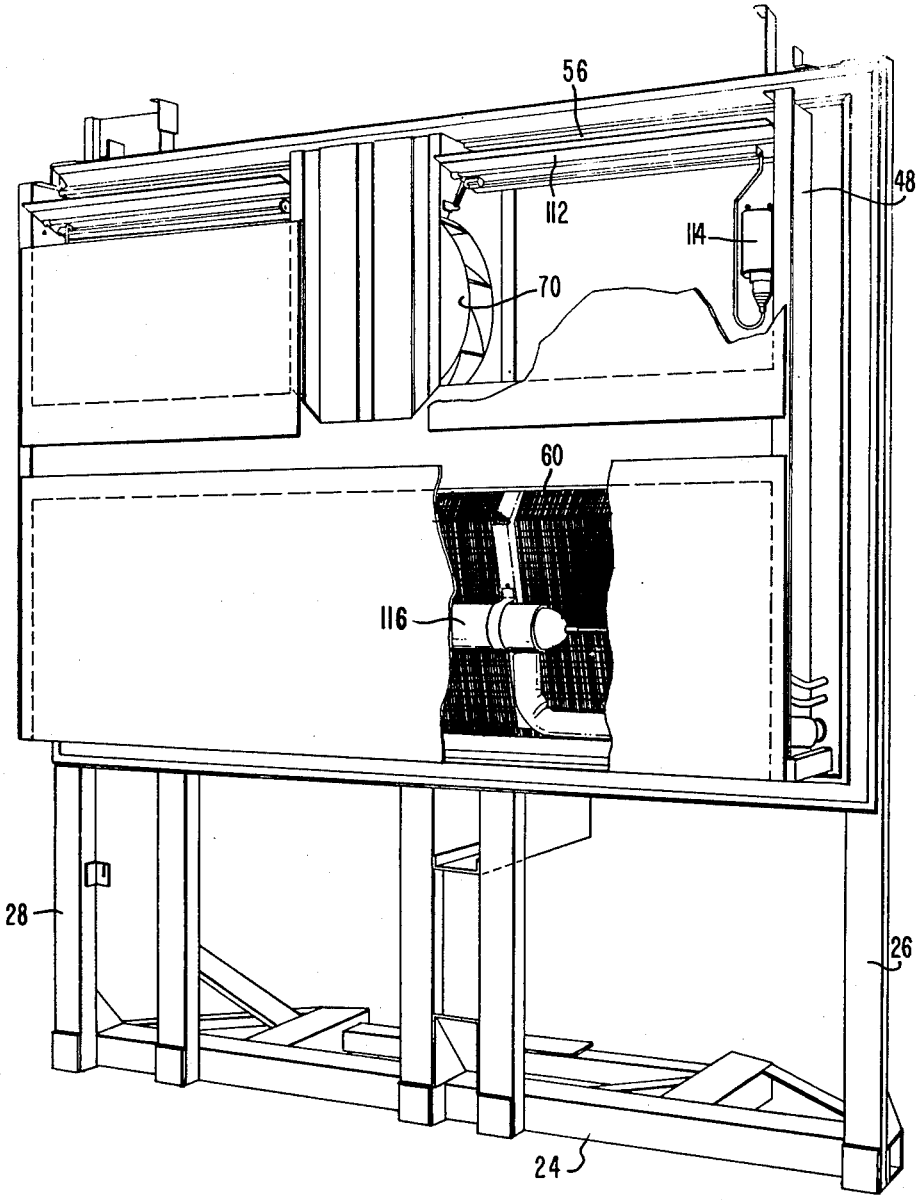
FIG. 5 is a perspective view of the rear of the unit with certain parts omitted and other parts shown basically in outline form.

Referring to FIGS. 2 and 5 the path of the airflow will be described in connection with the centrifugal blower 70 being located in the upper rear portion 64 of the plenum. With the blower operating, air is drawn into the vertical duct 54 from adjacent the floor of the trailer interior cargo space, and passes into the bottom inlet opening 52, through the evaporator coil 60 into the upper front space 66 of the plenum and is then forced out through the upper opening 56 at the top corner of the plenum and back into the trailer. A damper 112 controlled by damper operator 114 (FIG. 5) functions to close the opening during periods of defrost of the evaporator coil 60. While as noted before the heat exchange coil 60 has been characterized as a refrigerant evaporator since that is its major function, the coil 60 may also be supplied at times with hot gas from the refrigerant compressor to perform a heating function, as is conventional in the art. Therefore the term "evaporator" as used herein is not to be taken as limiting the use of the coil exclusively to that of an evaporator.

The arrangement of the components according to the invention also lend themselves to permitting reverse airflow through the plenum for those applications in which it is desired that the air discharge from the plenum be downwardly rather than upwardly. To accomplish this, the blower 70 and vertical partition 62 are reversed so that the blower is located in the upper front space 66.

It will be appreciated that regardless of the direction of airflow, the additional air opening holes 58 in the sidewalls of the plenum projecting into the trailer permit additional airflow into or out of the plenum in accordance with the direction of airflow therethrough.

The component arrangement also lends itself to locating a heat exchanger (FIGS. 2 and 5) in the generally triangular space adjacent the downwardly facing airflow face of the coil 60. The heat exchanger 116 is a refrigerant heat exchanger in which heat transfer occurs between the liquid and suction lines of the refrigerant system.

Figure 6:
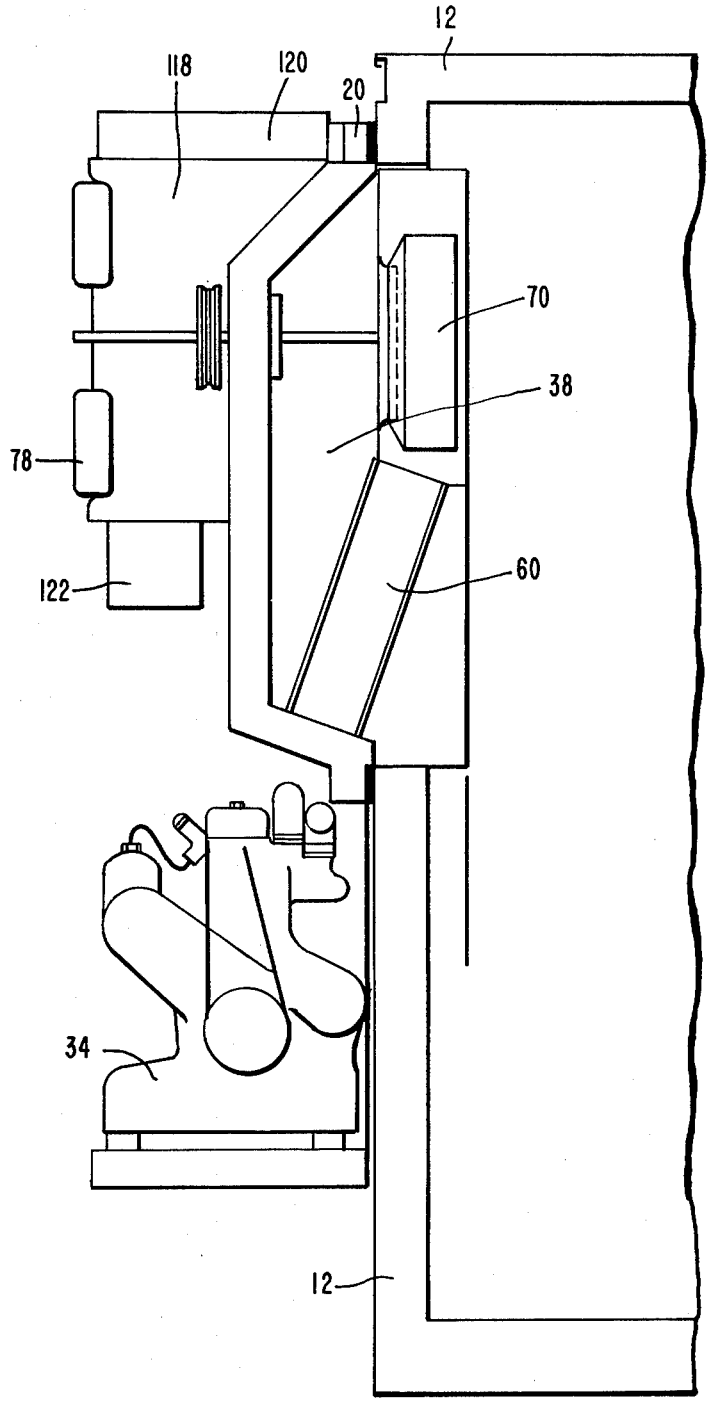
FIG. 6 is an outline view in the nature of a side elevation showing an alternative arrangement of locating the condenser, engine radiator, and condenser fan.

In FIG. 6, an alternative arrangement is provided in which a chamber 118 is defined at the upper front of the unit and has a front opening in which the condenser fan 78 is located, and the open top of the chamber is spanned by the horizontally disposed condenser 120 and a more limited area, open bottom of the chamber is covered by the engine radiator 122. While this is not the currently preferred form that the refrigeration unit according to the invention takes, it still partakes of the concept of the invention in that the load of all the parts is transferred to the generally planar frame 20 which is also provided in the FIG. 6 embodiment, and the airflow plenum forward displacement is accommodated.

In light of the foregoing description of the invention, and partly in summary, it will likely be appreciated that the invention provides a component arrangement and structural relationship which: provides the requisite capacity for the transport refrigeration unit in a space forwardly of the front wall of the trailer within the prescribed trailer swing radius, and which projects into the upper part of the trailer for about the depth (about four inches) of the vertical duct at the front wall to thereby reduce the unit protrusion into the trailer; uses a single shaft drive for both the condenser and evaporator blowers through a relatively simple and straightforward belt drive system; locates the engine-compressor unit in a space below and separate from the condenser-radiator space to promote isolation of the noise generated by the engine-compressor unit; permits mounting the engine-compressor unit in a way in which the plane passing through the mounting points extends fairly closely to the center of gravity of the engine-compressor unit; has a structural support and mounting arrangement for the components which results in transferring the support of the components back to a main planar frame, which in turn permits the use of front cover means which need not provide component support and thereby has concomitant advantages; and accommodates a relocation of several components to permit a reverse airflow arrangement.

We claim:

1. A transport refrigeration unit adapted to be mounted on the front wall of a trailer for conditioning the interior of the trailer, comprising:

an internal combustion engine and a refrigerant compressor driven thereby and connected together to form an engine-compressor unit, a refrigerant condenser, and a refrigerant evaporator;

a generally planar frame adapted to be mounted against the front wall of the trailer and seal around an opening in the front wall of the trailer;

wall means defining a generally vertically disposed plenum encompassed by the upper part of said frame above an intermediate level cross member of said frame, said plenum being disposed relative to the plane of said frame with a material part of the front-to-rear depth of the plenum being forwardly of said plane;

upper support means extending forwardly from the upper part of said frame and the front wall of said plenum to provide the total support of said condenser;

lower support means extending forwardly from the lower part of said frame below said plenum supporting said engine-compressor unit totally from said frame in a position underlying said condenser and the forward depth of said plenum;

said refrigerant evaporator being disposed in the lower part of said plenum and sloping upwardly and rearwardly, the upper portion of said plenum above said evaporator including a vertically disposed partition having a blower inlet therein and separating said upper portion of the plenum into an upper rear space and an upper front space, said upper front space being in communication with the upper airflow face of said evaporator, and said upper, rer space being in communication with the interior of the trailer;

an evaporator blower in said upper portion of said plenum for circulating air from said trailer through said plenum; and a removable front cover secured to said planar frame and encompassing those parts forwardly of said planar frame.

2. A unit according to claim 1 wherein:

said front-to-rear depth of said plenum is approximately the same on opposite sides of the plane of said frame.

3. A unit according to claim 1 wherein:

said condenser is supported in a generally vertical disposition spaced apart forwardly of said plenum; and a second blower disposed between said plenum and said condenser and having a driving shaft common to said evaporator blower.

4. A unit according to claim 1 wherein:

said upper support means includes a pair of spaced-apart upper and lower beam means supporting the sides of said condenser, and a diagonal tie rod extending between the beam means on each side to promote the transfer of support back to said planar frame.

5. A unit according to claim 1 wherein:

said lower support means includes an upper cantilever beam projecting forwardly from said cross member of said frame, and a lower beam projecting forwardly from the bottom member of said frame, said upper cantilever beam mounting one upper end of said engine and said lower beam mounting the opposite lower end of said engine, said upper beam and said lower beam being spaced in a horizontal direction relative to the engine dimensions that the mounting plane passes in the general vicinity of the center of gravity of said engine-compressor unit.

6. A unit according to claim 1 wherein:

said plenum includes means defining air inlet opening means along the bottom face of the rear of said plenum; and said evaporator blower is located in said upper rear space to draw air from said trailer into said plenum through said inlet opening means, and then pass it through said evaporator, said upper front space, said evaporator blower and back into said trailer from the upper part of said rear space.

7. A unit according to claim 6 wherein:

said plenum includes side walls having additional air inlet opening means in the lower, rear portions thereof.

8. A unit according to claim 3 wherein:

a vertically disposed engine radiator is located above said condenser.

9. A transport refrigeration unit adapted to be mounted on the front wall of a trailer for conditioning the interior of the trailer, comprising:

an internal combustion engine and a refrigerant compressor driven thereby, a refrigerant condenser, and a refrigerant evaporator;

a generally planar frame adapted to be mounted against the front wall of the trailer and seal around an opening in the front wall of the trailer;

wall means defining generally vertically disposed plenum encompassed by the upper part of said frame above an intermediate level cross member of said frame, said plenum being disposed relative to the plane of said frame with a material part of the front-to-rear depth of the plenum being forwardly of said plane with a lesser part of said plenum projecting into the cargo space of said trailer than is forwardly of said cargo space;

upper support means extending forwardly from the upper part of said frame and the front wall of said plenum to provide the total support of said condenser;

lower support means extending forwardly from the lower part of said frame below said plenum supporting said engine and compressor totally from said frame in a position underlying said condenser and the forward depth of said plenum;

said refrigerant evaporator being disposed in one part of said plenum, the other part of said plenum including partition means therein having a blower inlet therein and separating said other portion of the plenum into a first space in communication with the one airflow face of said evaporator, and a second space in communication with the interior of the trailer;

an evaporator blower in said other part of said plenum for circulating air from said trailer through said plenum; and a removable cover secured to said planar frame and encompassing those parts forwardly of said planar frame.

10. A unit according to claim 9 wherein said cover comprises an integral unit devoid of structural parts providing any significant support to those parts it encompasses.

* * * * *